US008528449B2

(12) United States Patent
Cheng

(10) Patent No.: US 8,528,449 B2
(45) Date of Patent: Sep. 10, 2013

(54) T-SHAPED DRIVING TOOL

(76) Inventor: Chin-Shun Cheng, Taichung (TW)

( * ) Notice: Subject to any disclaimer, the term of this patent is extended or adjusted under 35 U.S.C. 154(b) by 428 days.

(21) Appl. No.: 12/982,919

(22) Filed: Dec. 31, 2010

(65) Prior Publication Data

US 2012/0167726 A1 Jul. 5, 2012

(51) Int. Cl.
*B25B 23/16* (2006.01)

(52) U.S. Cl.
USPC ..... 81/177.5; 81/177.85

(58) Field of Classification Search
USPC ..... 81/177.5, 177.75, 177.7, 177.85
See application file for complete search history.

(56) References Cited

U.S. PATENT DOCUMENTS

| | | | | | |
|---|---|---|---|---|---|
| 662,966 | A * | 12/1900 | Robertson | ..... | 81/177.7 |
| 1,416,461 | A * | 5/1922 | Hance | ..... | 81/177.5 |
| 1,746,387 | A * | 2/1930 | Faw | ..... | 81/177.5 |
| 6,327,941 | B1 * | 12/2001 | Cheng | ..... | 81/177.85 |
| 7,040,200 | B2 * | 5/2006 | Lin | ..... | 81/177.5 |

* cited by examiner

*Primary Examiner* — Hadi Shaker

(57) ABSTRACT

A driving tool includes a driving shaft and a bar which movably extends through the driving shaft. At least one of two end sections of the bar has a hole and a recess, wherein an engaging member is engaged with the hole and protrudes out from outer surface of the bar. The recess is defined axially in the end of the at least one end section and a control rod and a resilient member are received in the recess. The control rod includes a first notch and a second notch of different depths. When the control rod is operated to overcome a force of the resilient, the engaging member is engaged with the second notch, the engaging member is retracted into the at least one end section. The bar can be separated from the driving shaft so as to change the driving shaft.

15 Claims, 25 Drawing Sheets

T-SHAPED DRIVING TOOL

FIELD OF THE INVENTION

The present invention relates to a driving tool, and more particularly, to a T-shaped driving tool including a driving shaft and a bar which is movably connected to the driving shaft and includes a control mechanism for separating the bar from the driving shaft.

BACKGROUND OF THE INVENTION

A conventional T-shaped driving tool is shown in FIGS. 31 and 32, and generally includes a driving shaft 61 and a bar 62, the driving shaft 61 has a driving member 611 connected to one end thereof and a passage 612 is defined in the other end of the driving shaft 61. The bar 62 movably extends through the passage 612 and two ends of the bar 62 each have a ball 63 which is partially protrudes out from the bar 62. The balls 63 restrict the bar 62 from disengaging from the passage 612 so that the bar 62 is movable to adjust the length of the arm of force when using the driving tool. However, the balls 63 are secured in the bar 62 and cannot be retracted so that the bar 62 cannot be separated from the driving shaft 61. This restricts the replacement of the driving member 611 on the driving shaft 61, and the T-shaped combination of the driving shaft 61 and the bar 62 occupies too much space.

The present invention intends to provide a T-shaped driving tool which includes a driving shaft and a bar that is perpendicularly and movably connected to an end of the driving shaft. The bar can be separated from the driving shaft by the control mechanism connected to one end of the bar.

SUMMARY OF THE INVENTION

The present invention relates to a driving tool and includes a driving shaft and a bar which movably extends through the driving shaft. At least one of two end sections of the bar has a hole and a recess, wherein an engaging member is engaged with the hole and protrudes out from outer surface of the bar. The recess is defined axially in the end of the at least one end section and a control rod and a resilient member are received in the recess. The control rod includes a first notch and a second notch of different depths. By the resilient member, the control rod is positioned at the first position where the engaging member is engaged with the first notch and protrudes out from the end section. When the control rod moves relative to the hole, the engaging member is engaged with the first notch or the second notch. When the control rod is operated to overcome a force of the resilient, the control rod is moved to the second position where the engaging member is engaged with the second notch, the engaging member is retracted into the at least one end section. The bar can be separated from the driving shaft so as to change the driving shaft.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 11:
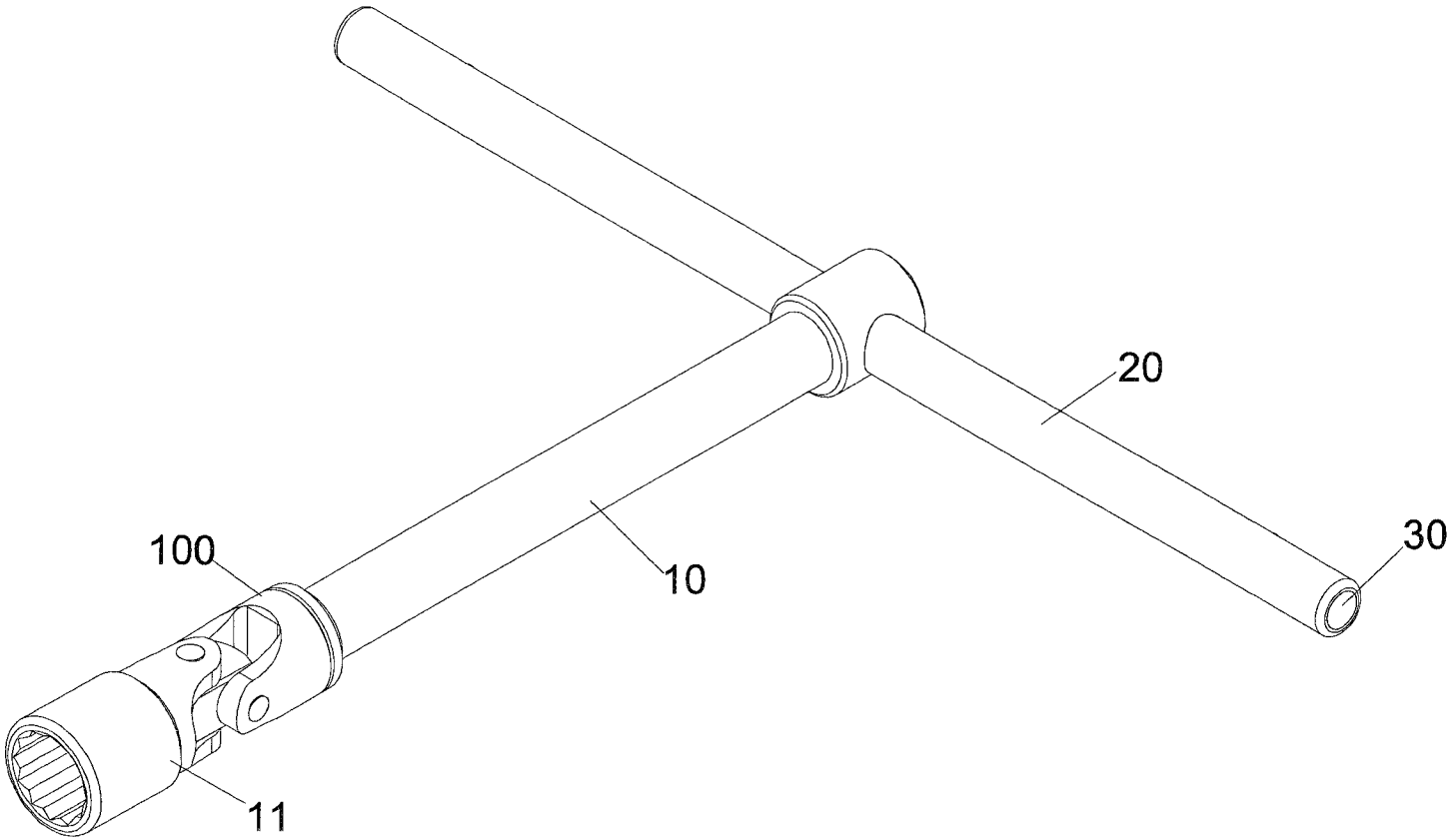
FIG. 11 shows the connection portion connected with a driving member.
Figure 12:
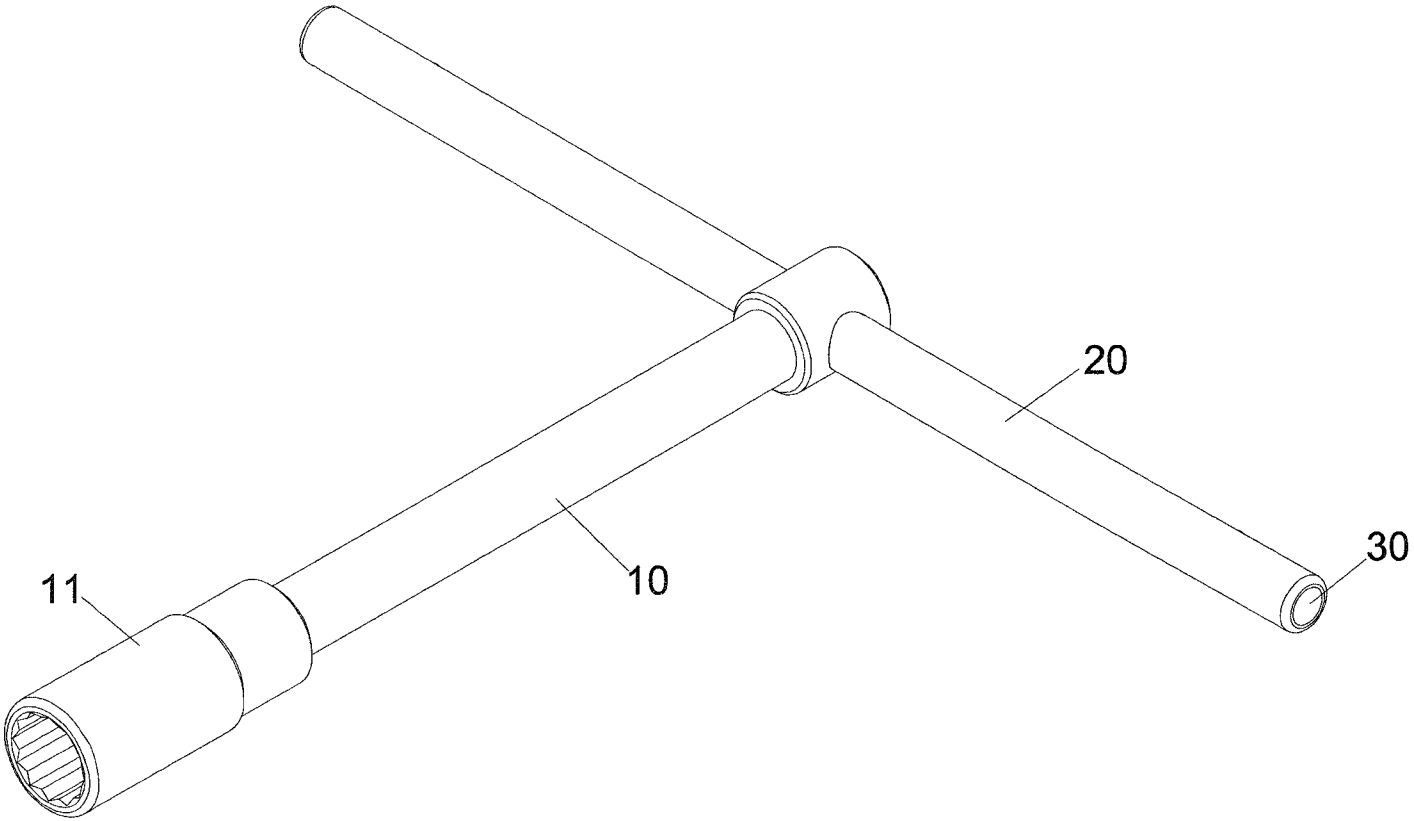
FIG. 12 shows another driving member connected to the connection portion.
Figure 13:
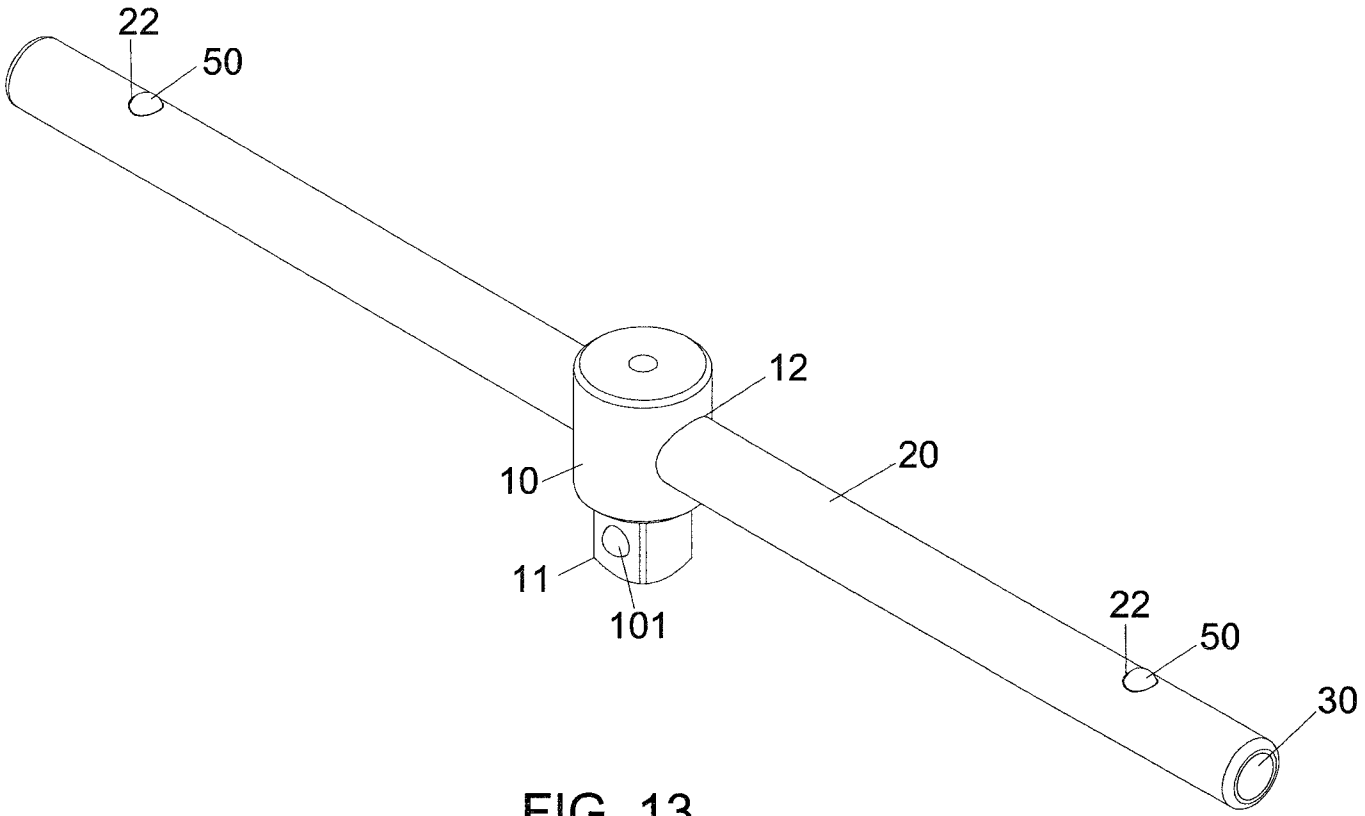
FIG. 13 shows another embodiment of the connection portion.
Figure 14:
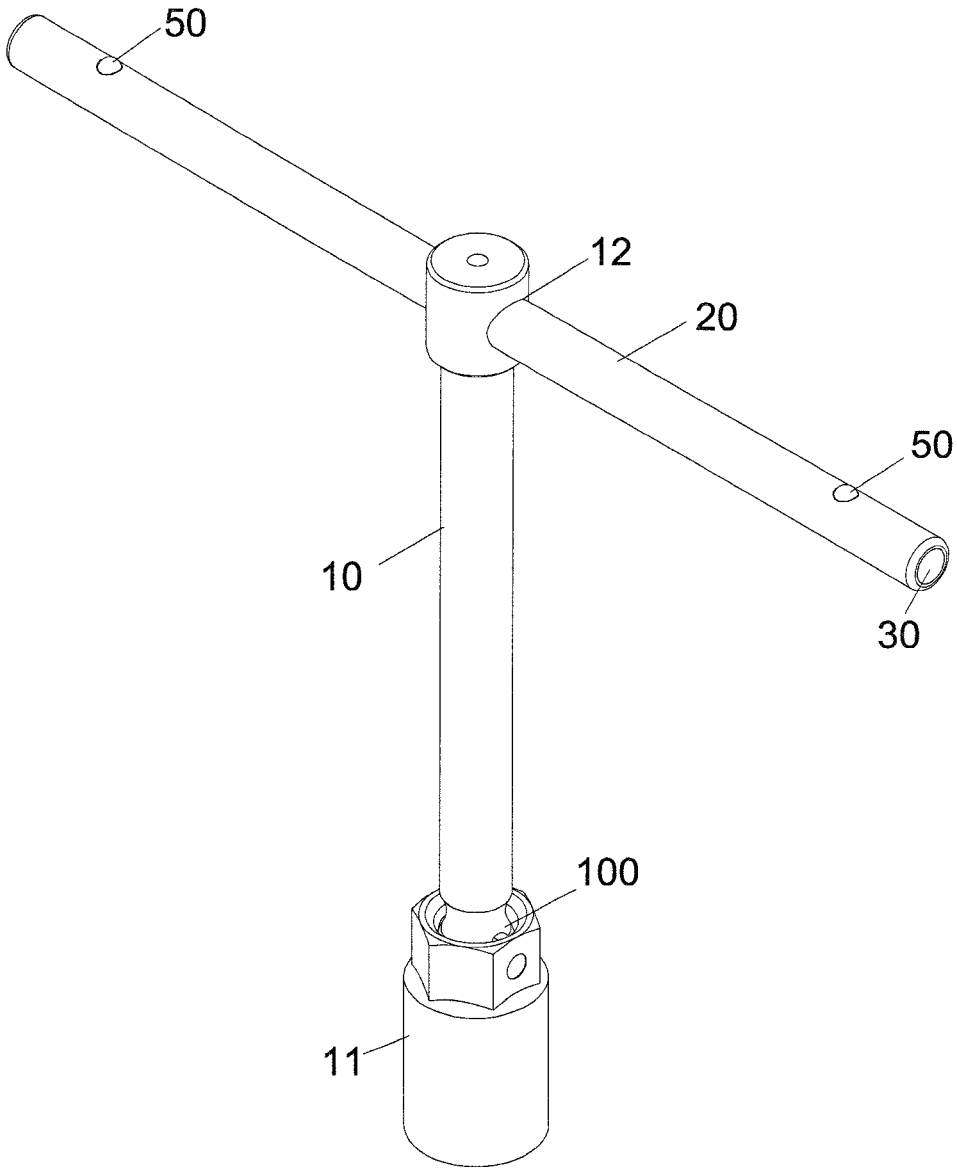
FIG. 14 shows yet another driving member connected to the connection portion.
Figure 15:
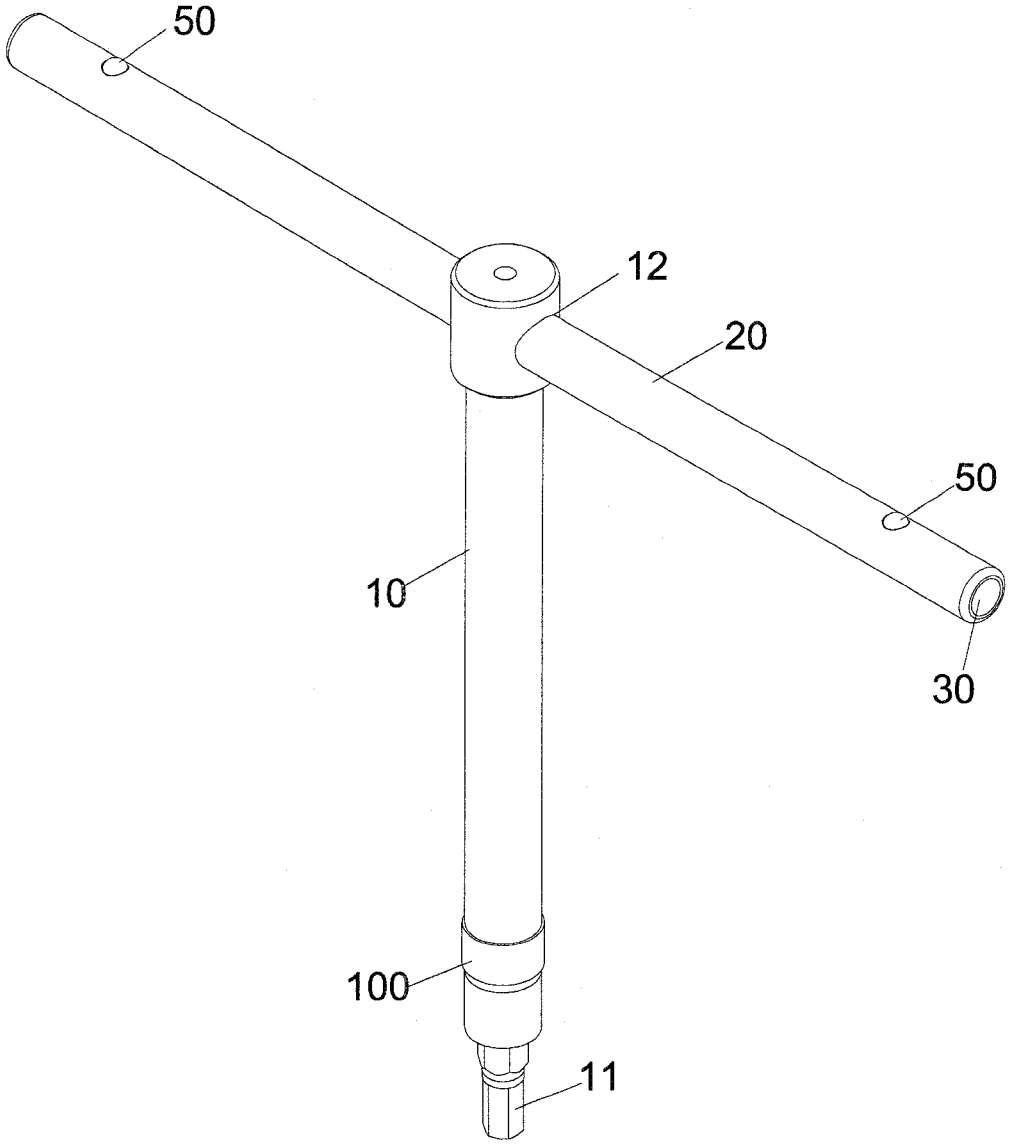
FIG. 15 shows yet another driving member connected to the connection portion.
Figure 16:
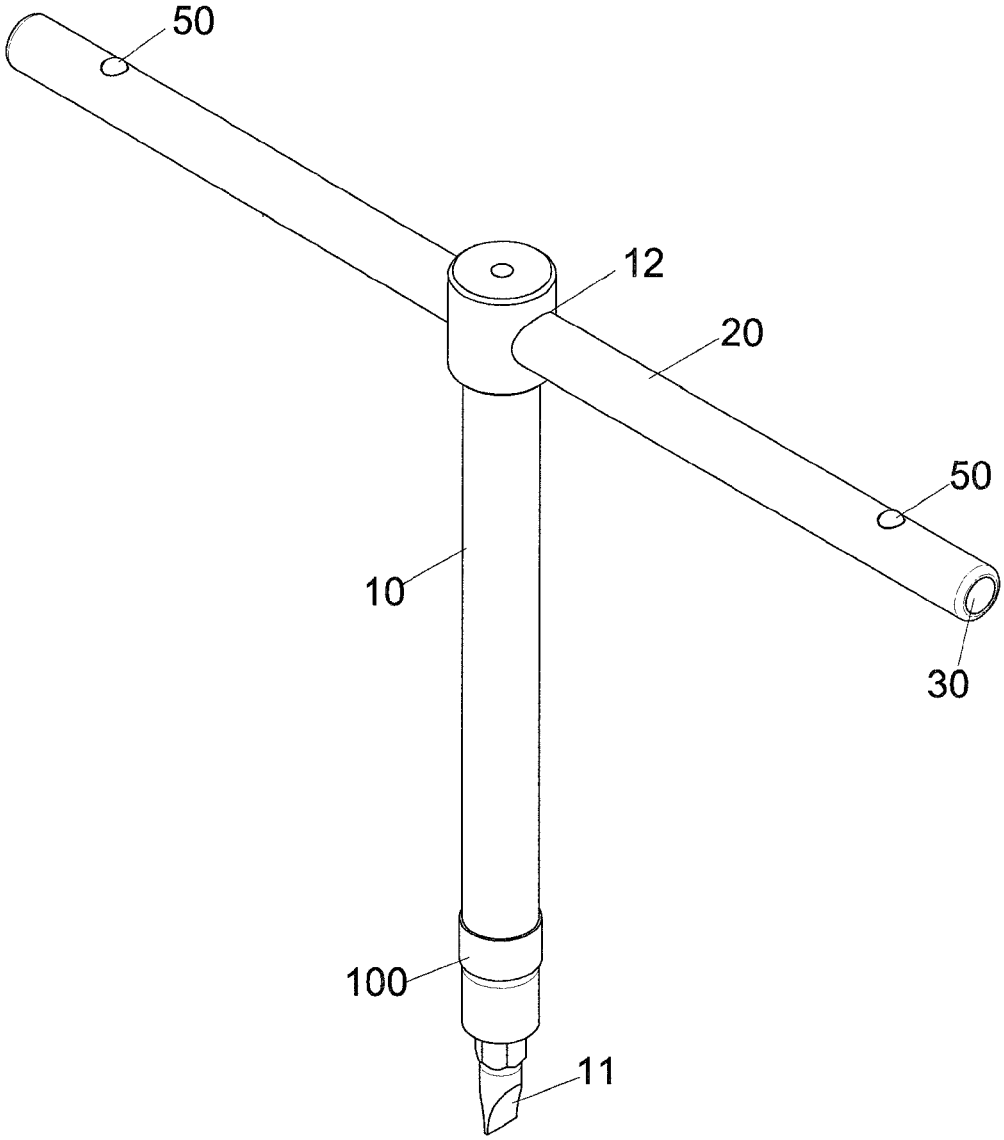
FIG. 16 shows yet another driving member connected to the connection portion.
Figure 17:
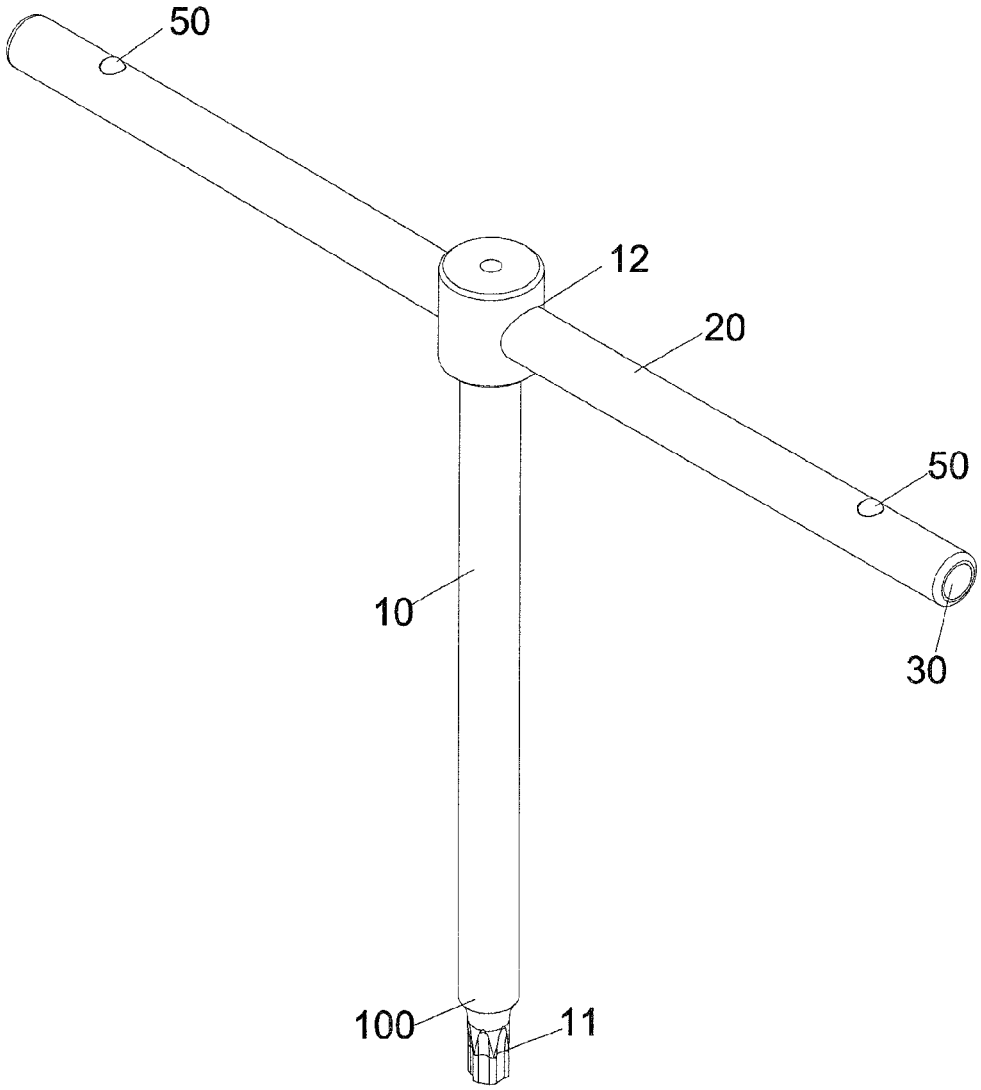
FIG. 17 shows yet another driving member connected to the connection portion.

Referring to FIGS. 1 to 8, the driving tool of the present invention comprises a driving shaft 10 and a bar 20, wherein the driving shaft 10 has a first end and a second end. The first end of the driving shaft 10 has a passage 12 and a connection portion 100 is connected to the second end of the driving shaft 10. A driving member 11 is connected to the connection portion 100. As shown in FIGS. 11, 12 and 14, the driving member 11 is a socket. As shown in FIGS. 11 and 14, the connection portion 100 is connected to the driving member 11 via a universe connector. As shown in FIG. 13, the connection portion 100 is a square-shaped part and a ball 101 is engaged with the wall thereof, the ball is biased by a spring so as to be partially protrude from the connector. As shown in FIG. 15, the driving member 11 is a hexagonal rod. As shown in FIG. 16, the driving member 11 is a bit which has a cabinet tip, a Phillips head tip or a hexagonal tip.

The bar 20 movably extends through the passage 12 and has two end sections 200 on two ends thereof. Each end section 200 has an engaging member 50 protruding out from outer surface thereof. The two engaging members 50 are stopped by the periphery of the passage 12 respectively to prevent the bar 20 from dropping off from the passage 12.

Figure 1:
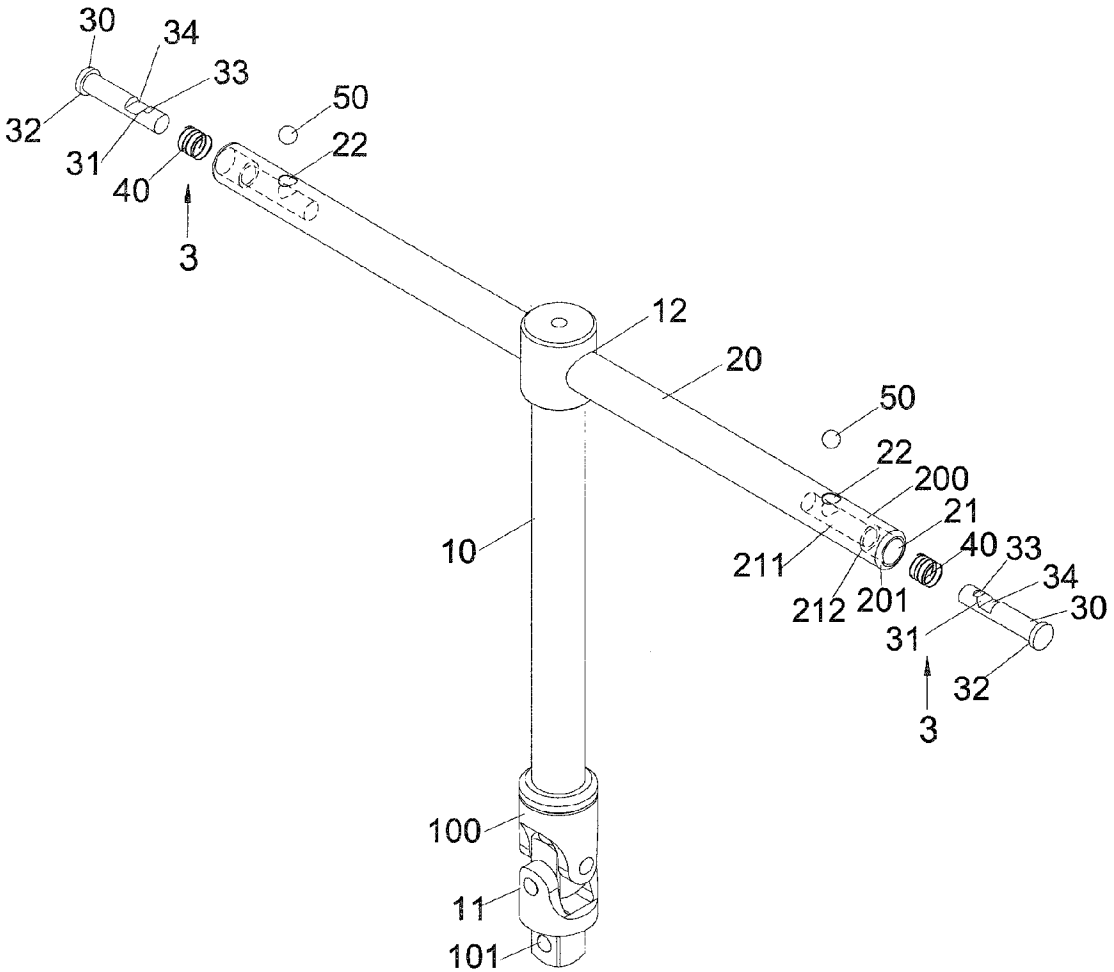
FIG. 1 is an exploded view to show the driving tool of the present invention.
Figure 2:
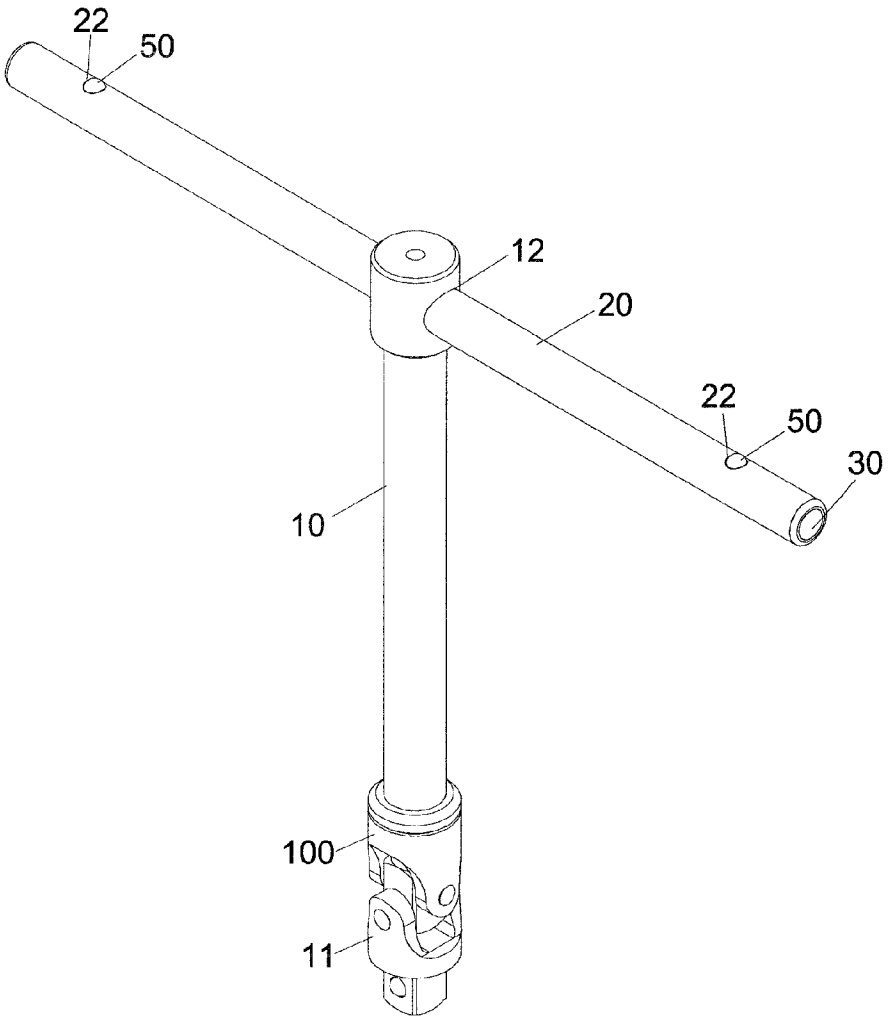
FIG. 2 is a perspective view to show the driving tool of the present invention.
Figure 3:
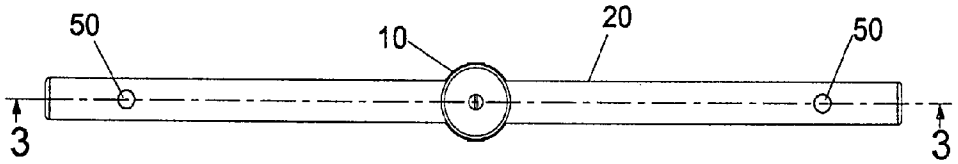
FIG. 3 is a top view of the driving tool of the present invention.
Figure 4:
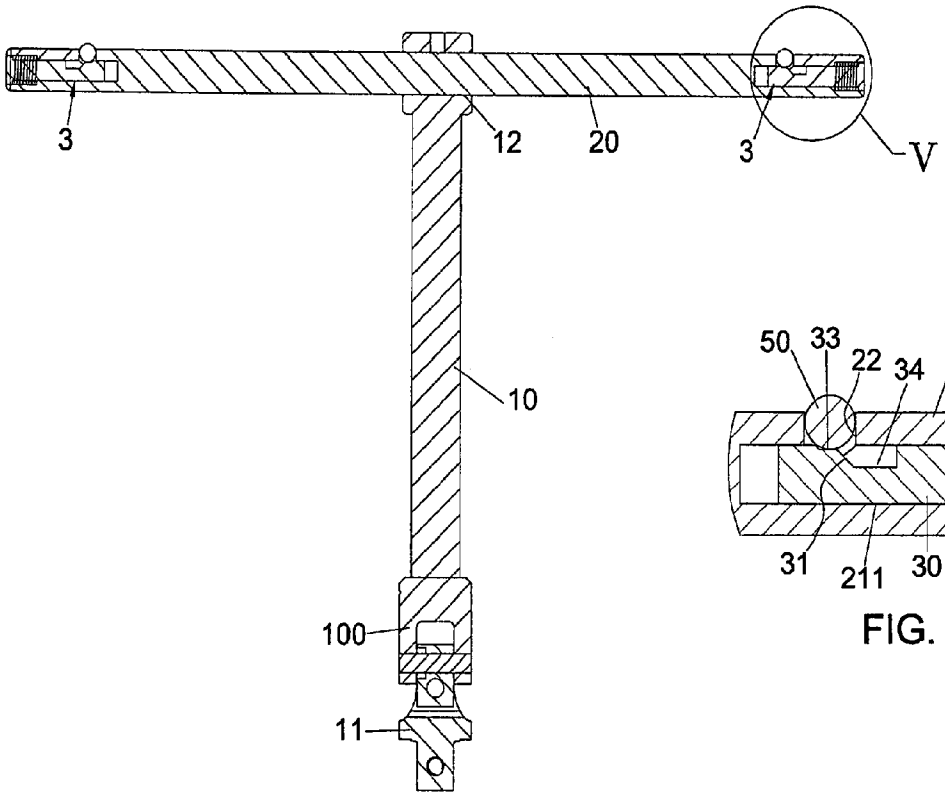
FIG. 4 is a cross-sectional view taken along plane 3-3 in FIG. 3.
Figure 5:
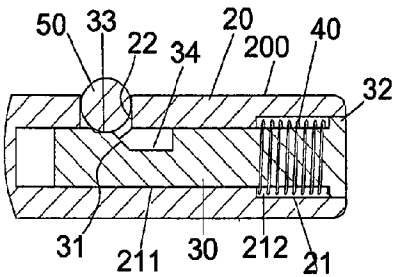
FIG. 5 is a cross-sectional view of the circled portion V in FIG. 4.
Figures 6, 7:
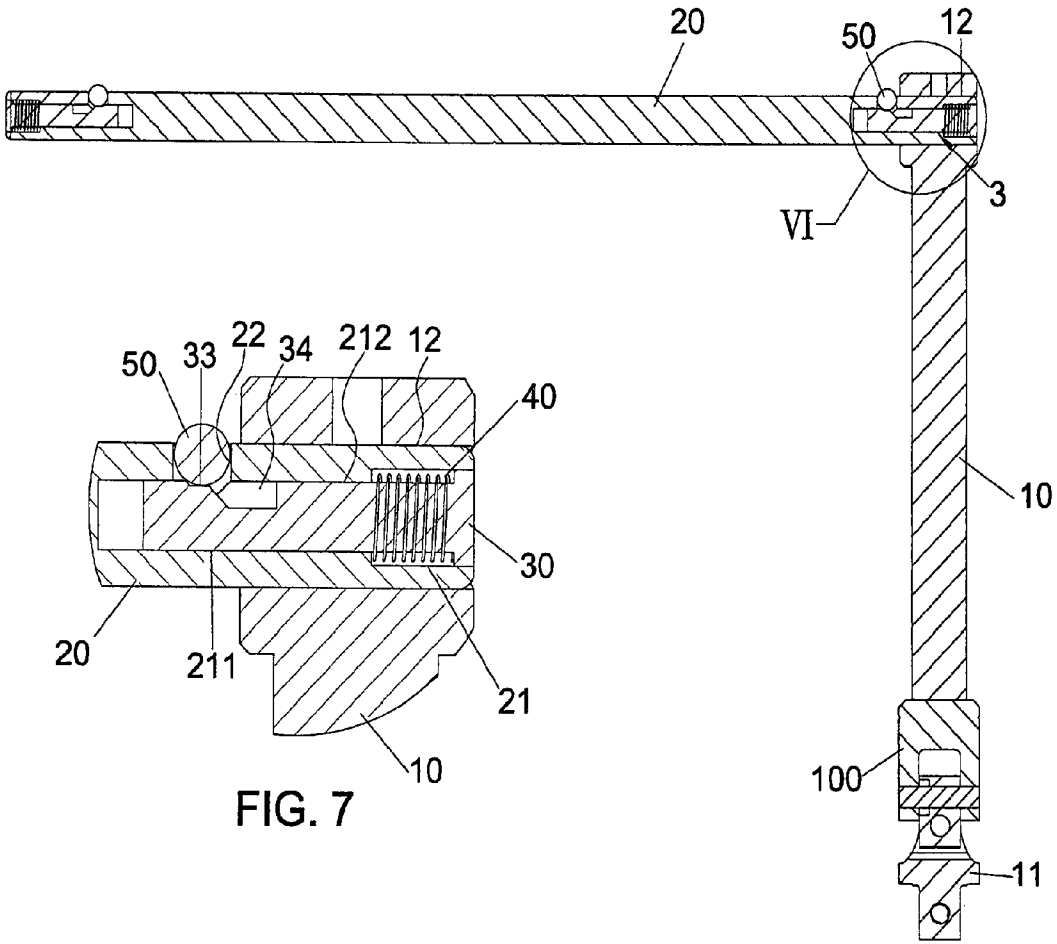
FIG. 6 is a cross-sectional view to show that the bar is about to extend through the passage of the driving shaft.
FIG. 7 is a cross-sectional view of the circled portion VI in FIG. 6.
Figure 9:
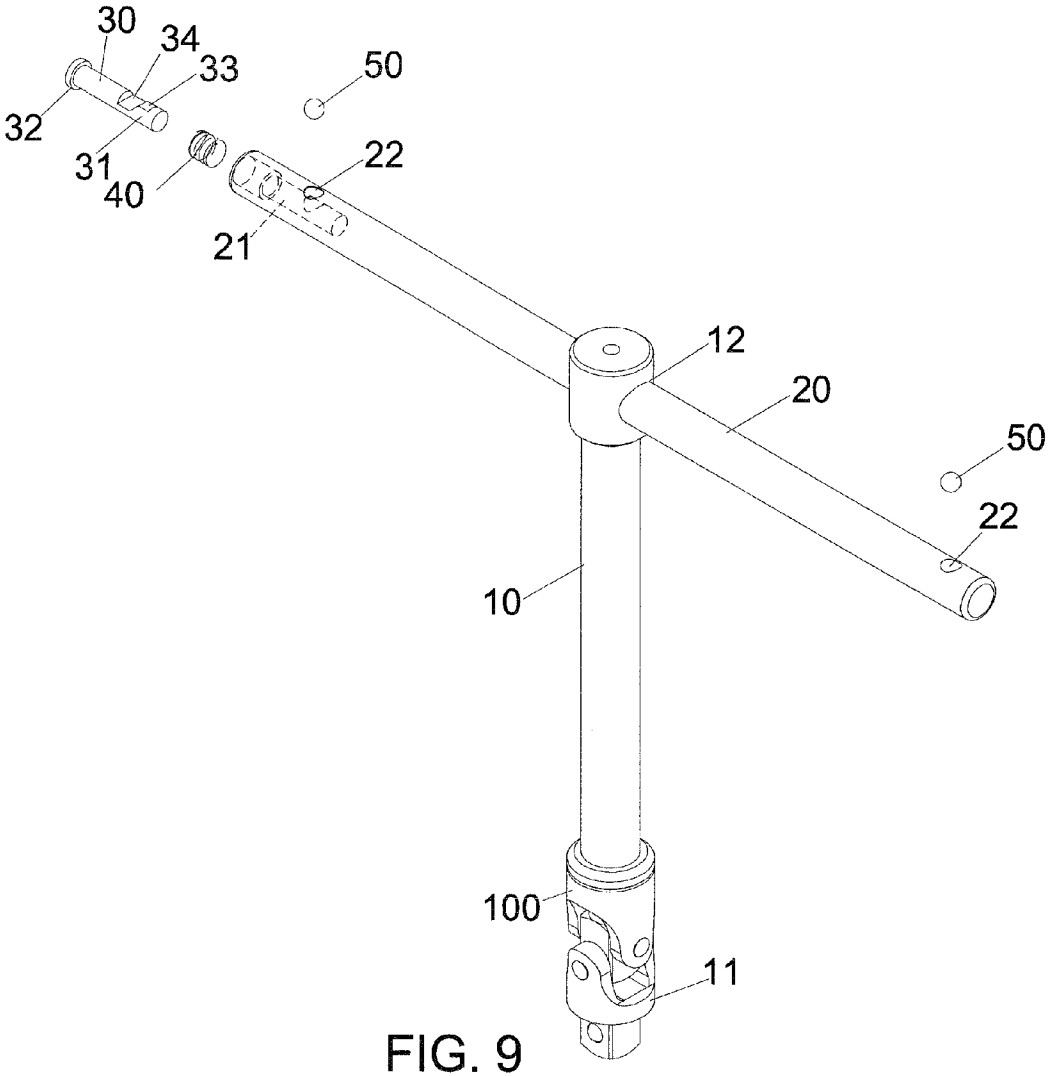
FIG. 9 shows that only one end section of the bar has the control mechanism connected thereto.

At least one of the two end sections 200 has a control mechanism 3 connected thereto. As shown in FIG. 1, both of the two end sections 200 have a control mechanism 3. As shown in FIG. 9, the control mechanism 3 controls the engaging member 50 to be retracted into the end section 200. A hole 22 is defined radially through a wall of the at least one end section 200 and a recess 21 is defined in an end of the at least one end section 200. The engaging member 50 is located in the hole 22 and, in this embodiment, the engaging member 50 is a ball. The recess 21 is defined axially on the distal end 201 of the at least one end section 200. A control rod 30 and a resilient member 40 are received in the recess 21. The resilient member 40 applies an elastic force to the control rod 30. The control rod 30 has a first notch 33 and a second notch 34 which is deeper than that of the first notch 33 as shown in FIG. 2. As shown in FIGS. 4 and 5, when the control rod 30 is located at a first position, the engaging member 50 is engaged with the first notch 33 which pushes the engaging member 50 to partially protrude from the at least one end section 200. When the control rod 30 is operated to overcome a force of the resilient 40 and located at a second position, the engaging member 50 is engaged with the second notch 34 so that the engaging member 50 is retracted into the at least one end section 200. By this way, the user can pull the bar 20 out from the passage 12 to separate the bar 20 and the driving shaft 10. The resilient member 40 returns the control rod 30 and the engaging member 50 protrudes from the end section 200 again as shown in FIGS. 6 and 7.

Figure 8:
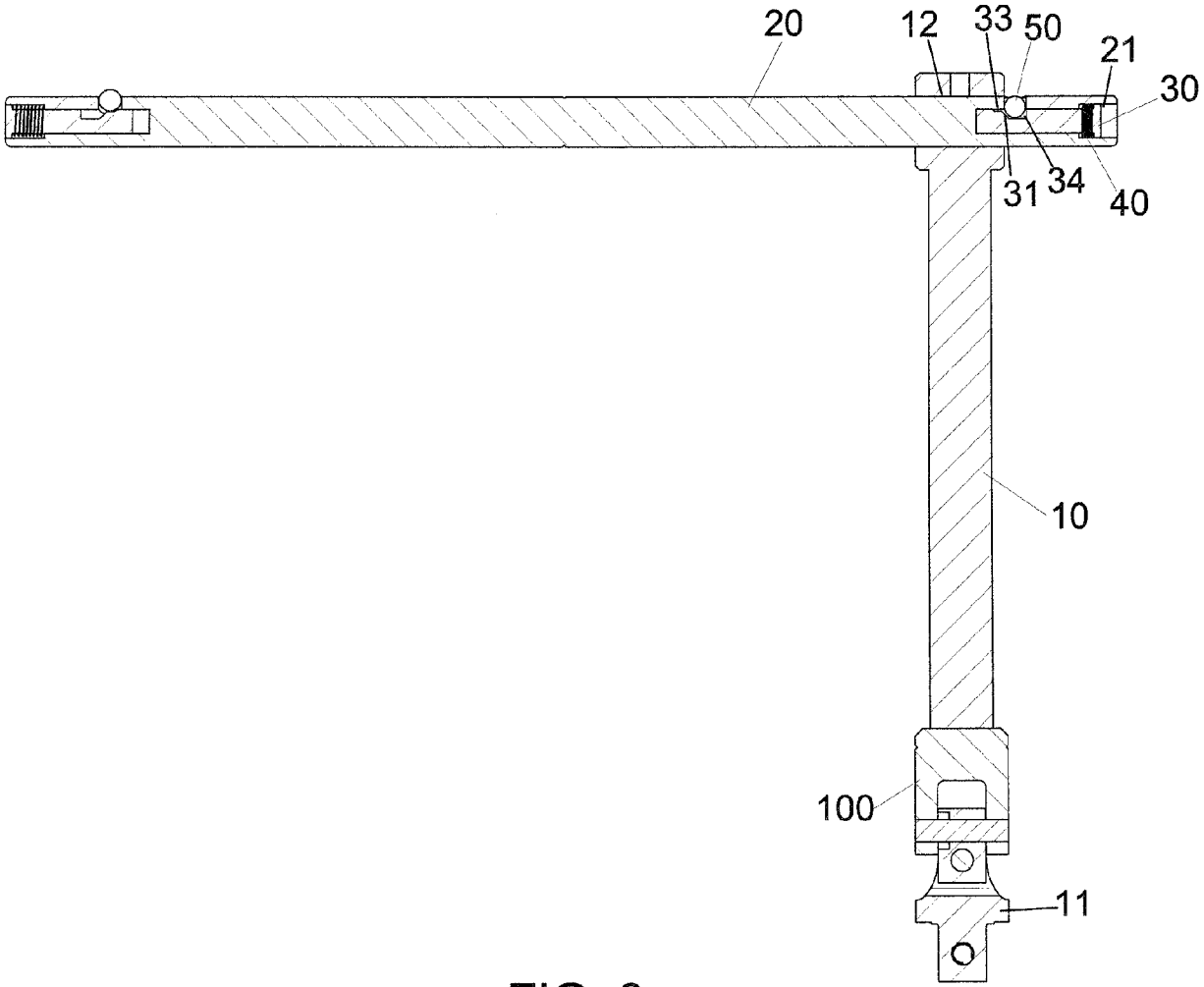
FIG. 8 is a cross-sectional view to show that the bar extends through the passage of the driving shaft.

As shown in FIGS. 5 and 8, the first and second notches 33, 34 are located axially on the periphery of the control rod 30, an inclined surface 31 is connected between the first and second notches 33, 34. When the control rod 30 is applied an axial force, the control rod 30 moves relative to the recess and the engaging member 50 moves from the first notch 33 to the second notch 34 via the inclined surface 31.

Figure 10:
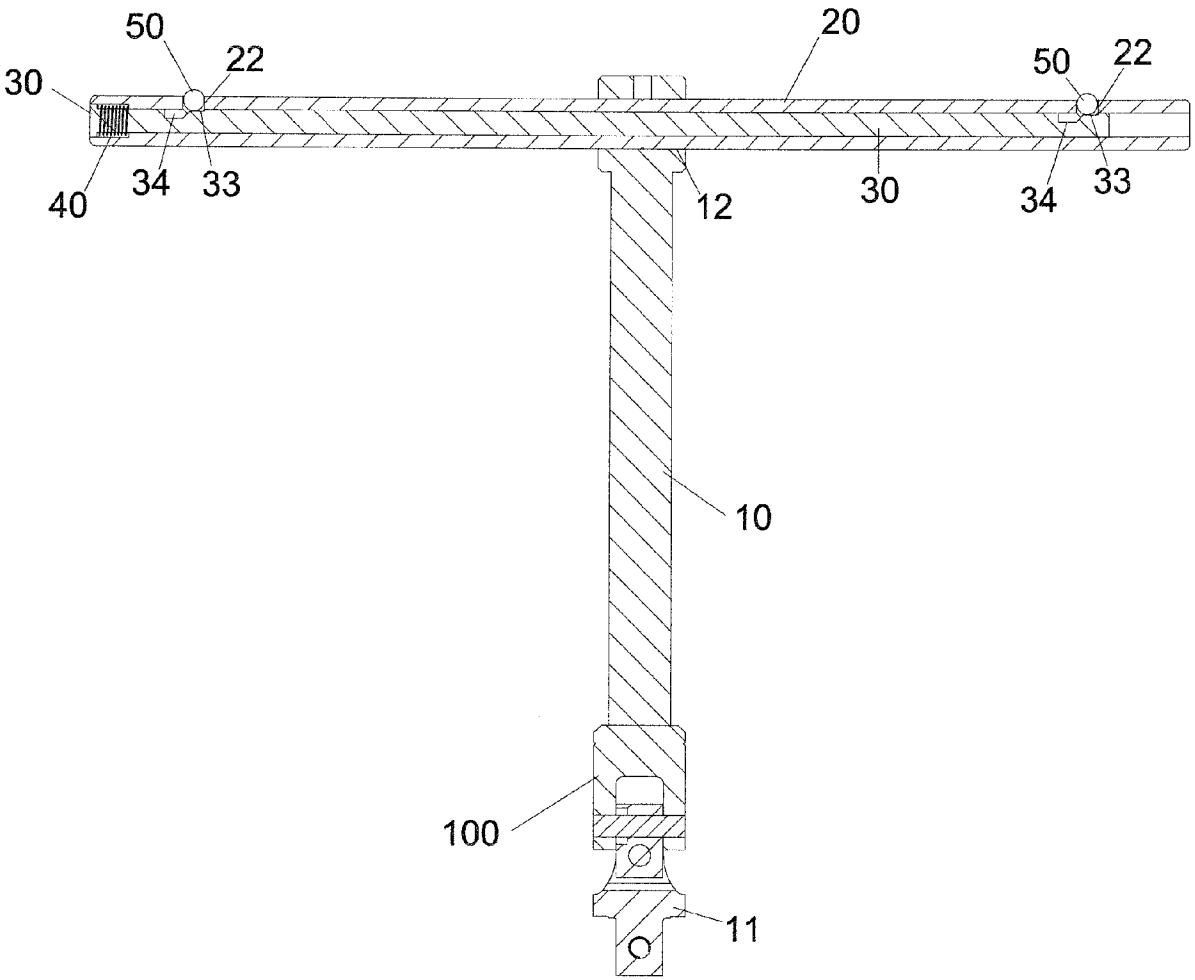
FIG. 10 shows another embodiment of the control mechanism of the present invention.

As shown in FIG. 10, in an embodiment of the present invention, the bar 20 has an axial passage defined therethrough which communicates with the two end sections 200. The control rod 30 extends through the axial passage of the bar 20 and includes two sets of first and second notches 33, 34 in the two ends thereof. When the control rod 30 moves, the two engaging members 50 are located in either the two first notches 33 or the two second notches 34 respectively.

Figure 18:
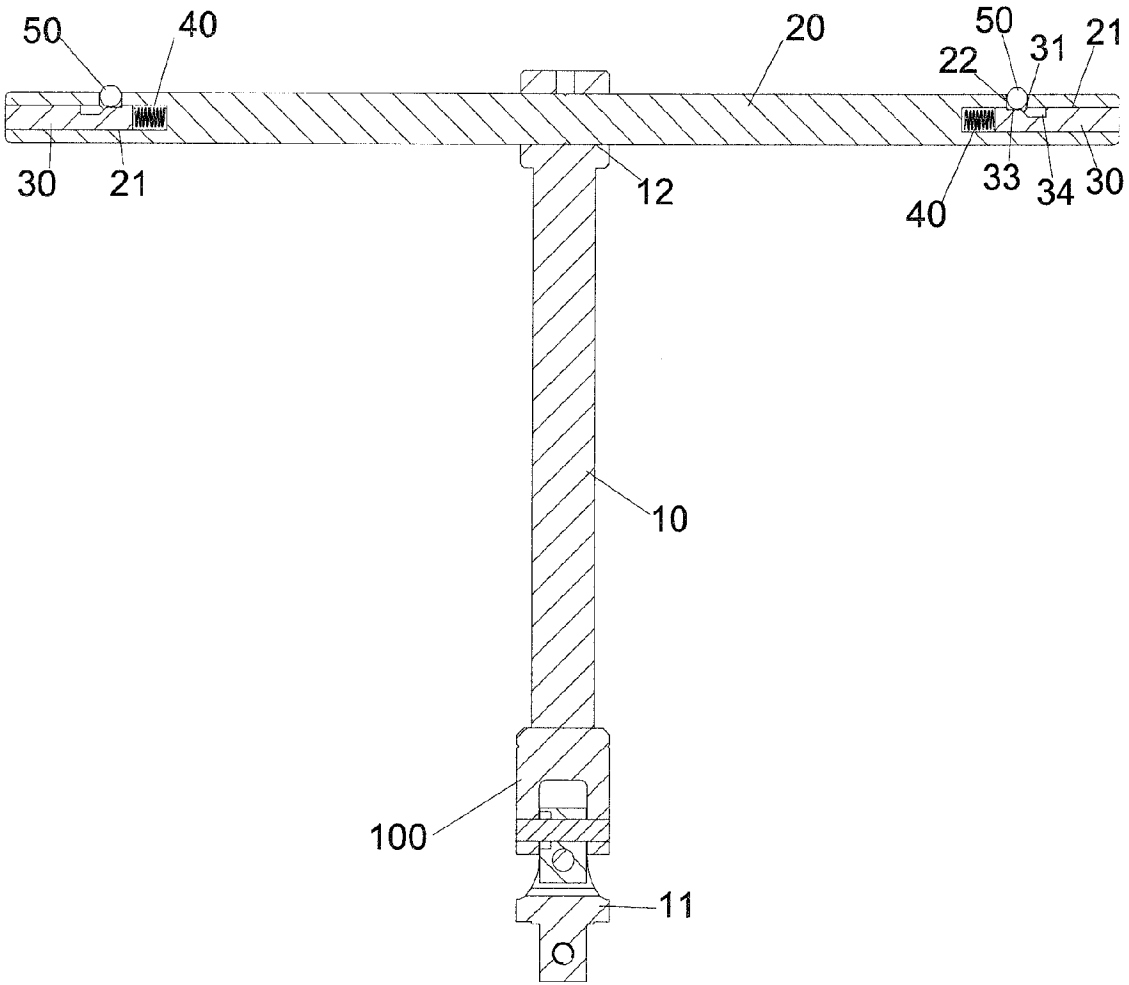
FIG. 18 is a cross-sectional view to show another embodiment of the recess and control rod.

As shown in FIGS. 1 and 5, the recess 21 includes a first section 212 and a second section 211. The first section 212 has an inner diameter larger than that of the second section 211 so as to form a shoulder between the first and second sections 212, 211. The control rod 30 includes an enlarged head 32 which is located within the first section 212 of the recess 21. The resilient member 40 is a spring which is mounted to the control rod 30 and two ends of the resilient member 40 are biased between the head 32 and the shoulder between the first and second sections 212, 211. As shown in FIG. 18, the recess 21 can also be the same diameter and the resilient member 40 is a spring which is biased between the control rod 30 and the inside of the recess 21.

Figure 19:
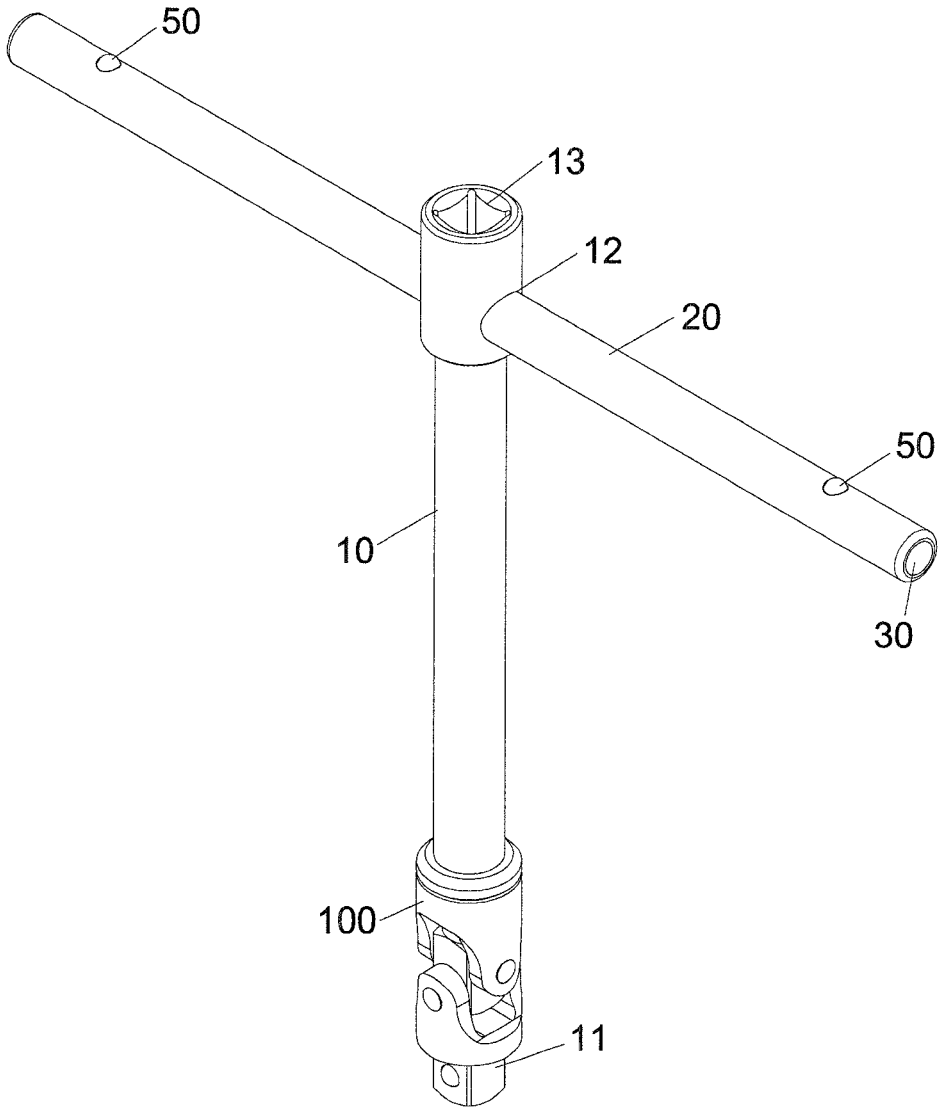
FIG. 19 shows that the driving shaft includes an engaging portion on the other end thereof.
Figure 20:
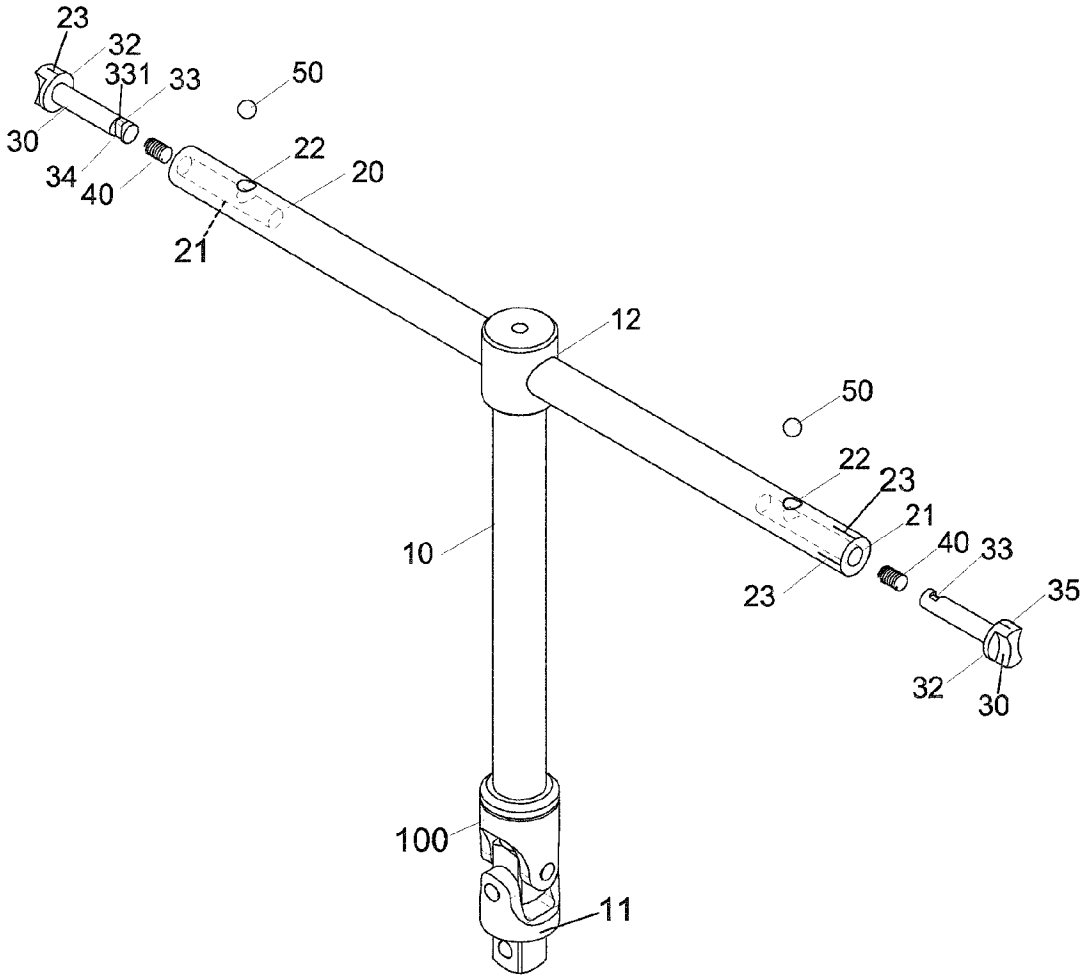
FIG. 20 is an exploded view to show another embodiment of the control mechanism.
Figure 21:
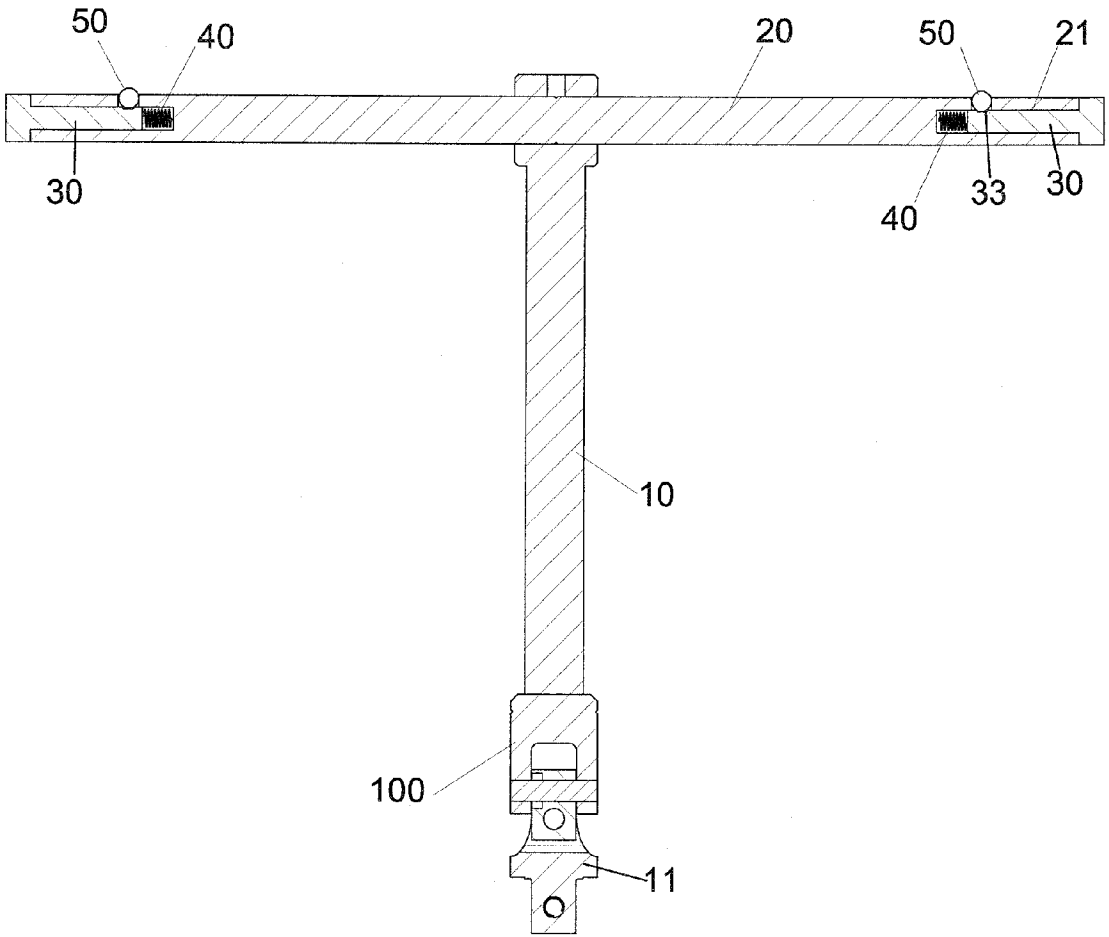
FIG. 21 is a side cross-sectional view to show the driving tool with the control mechanisms in FIG. 20.
Figures 22, 23, 24, 25:
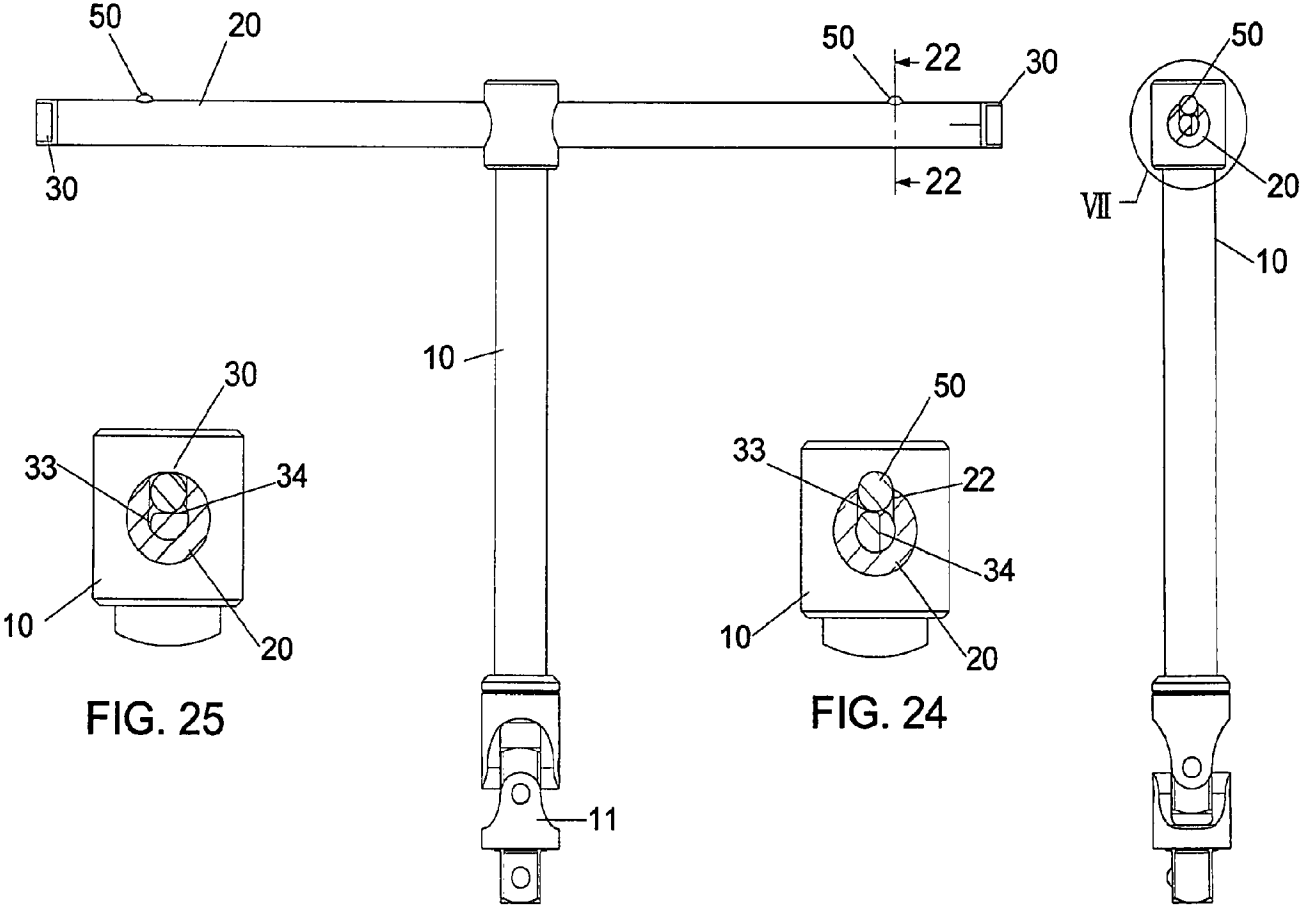
FIG. 22 is an end cross-sectional view to show the driving tool with the control mechanisms in FIG. 20.
FIG. 23 is a cross-sectional view taken along plane 22-22 in FIG. 22.
FIG. 24 is an enlarged view of the circled portion VII in FIG. 23.
FIG. 25 is a view similar to FIG. 24 and shows that the engaging member is retracted into the end section of the bar.
Figure 26:
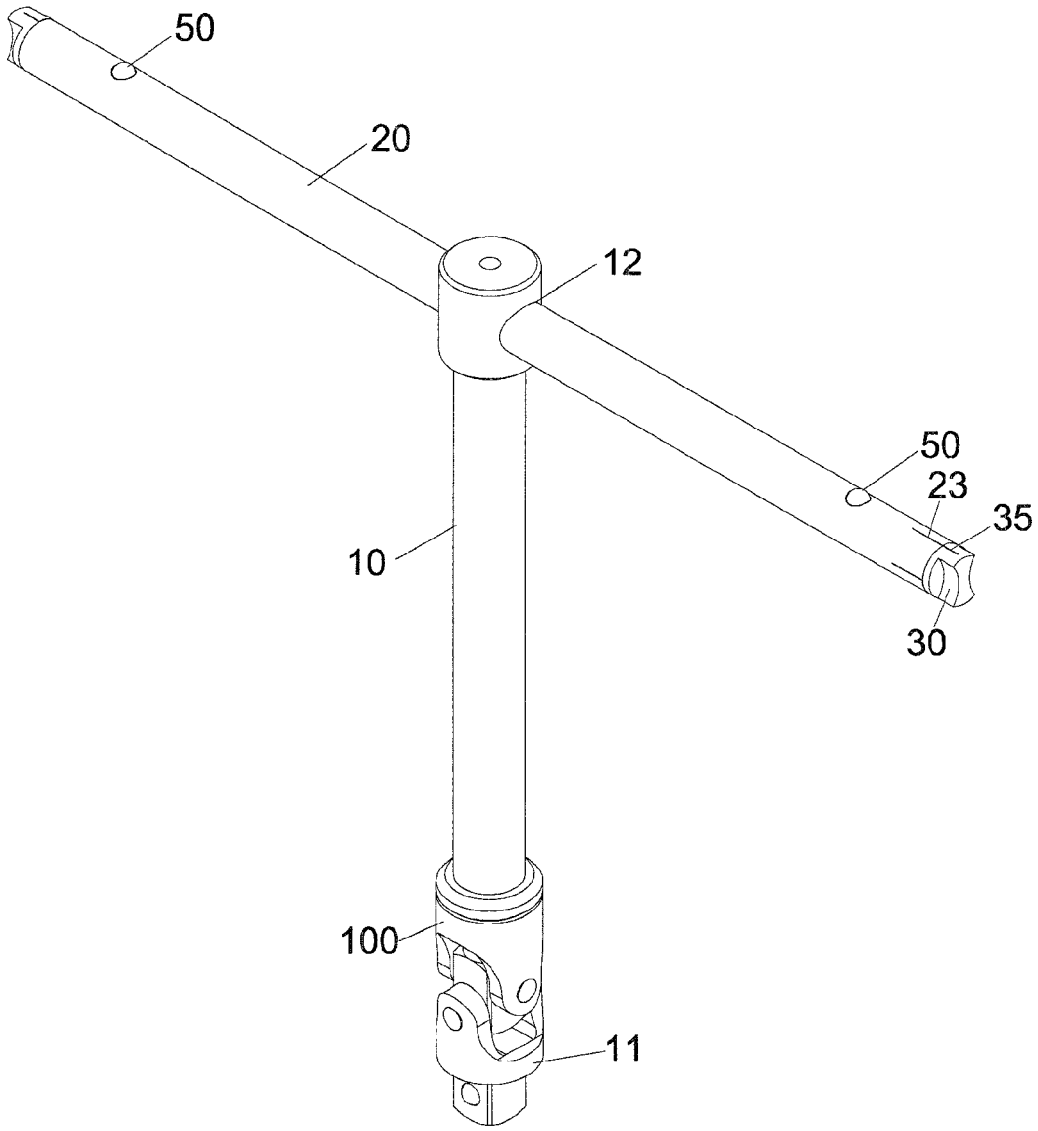
FIG. 26 is a view similar to FIG. 22 and shows that the engaging member is retracted into the end section of the bar.
Figure 27:
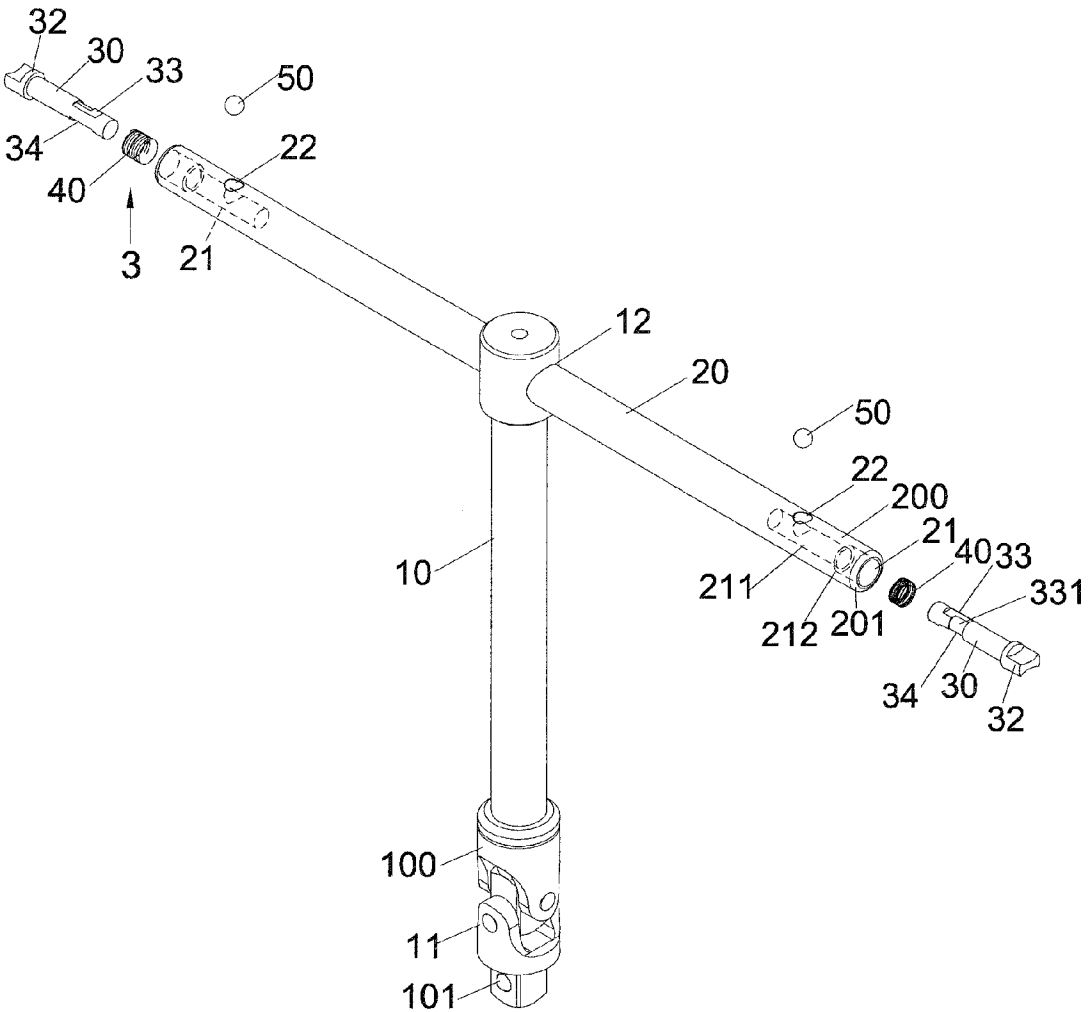
FIG. 27 is an exploded view to show another embodiment of the control mechanism of the present invention.
Figure 28:
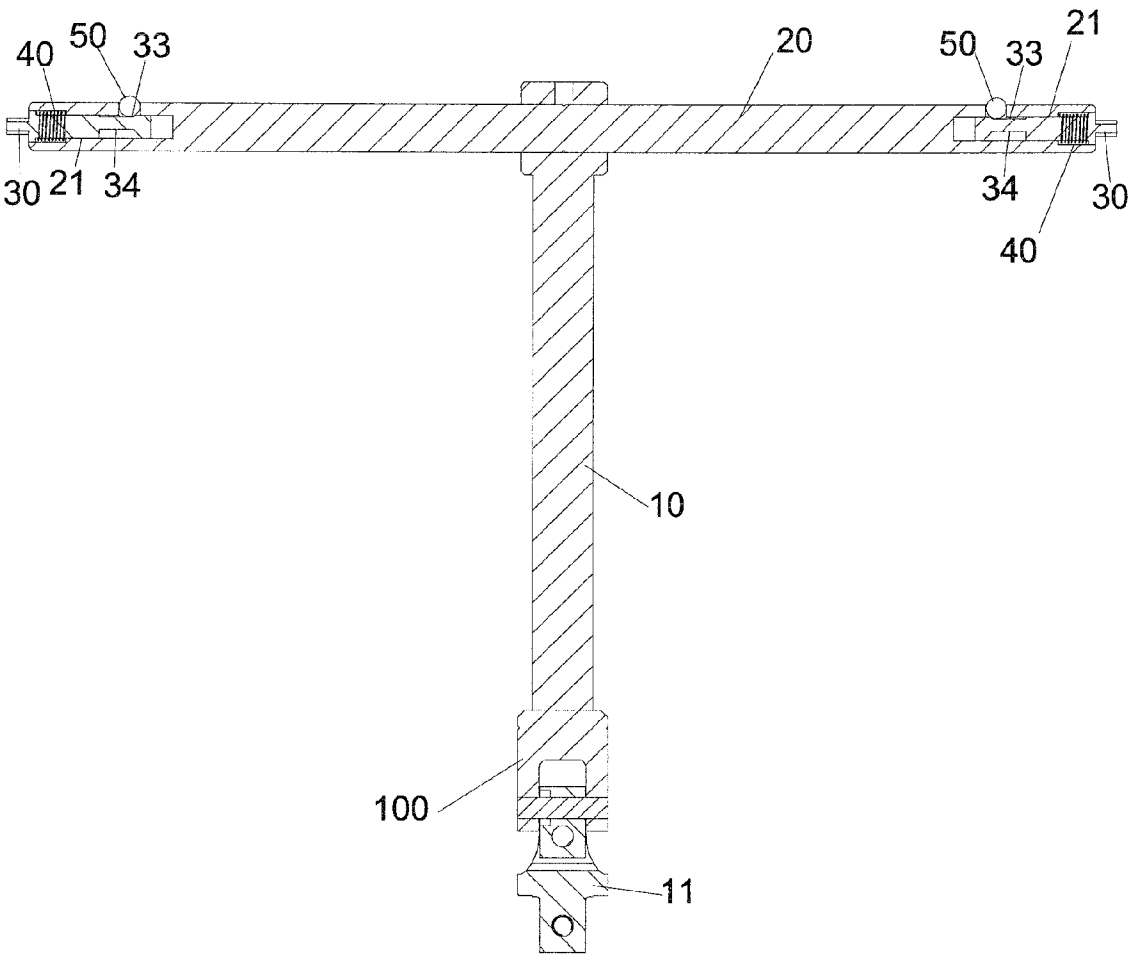
FIG. 28 is a cross-sectional view to show that the engaging member, in FIG. 27, protrudes from the end section of the bar.
Figure 29:
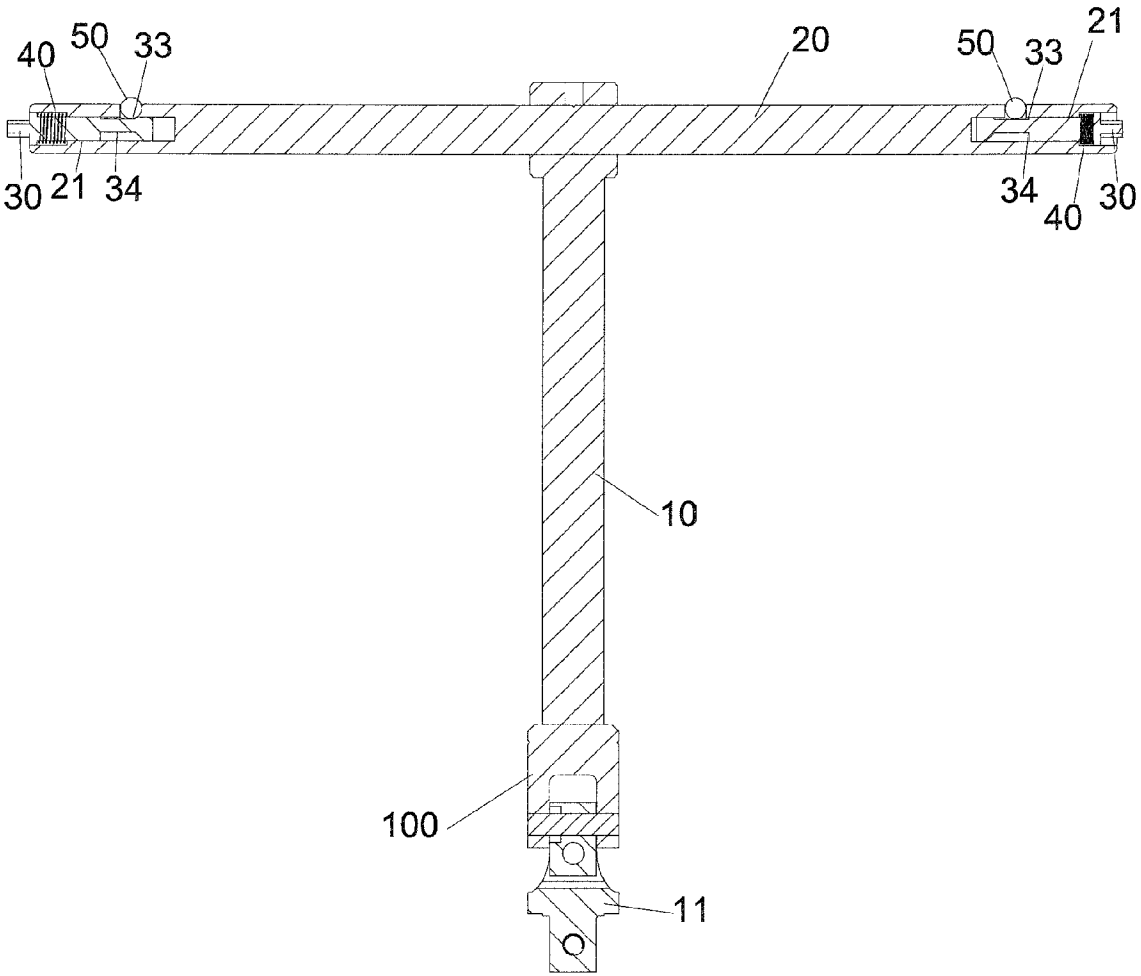
FIG. 29 is a cross-sectional view to show that the control rod, in FIG. 27, is pushed into the end section of the bar.
Figure 30:
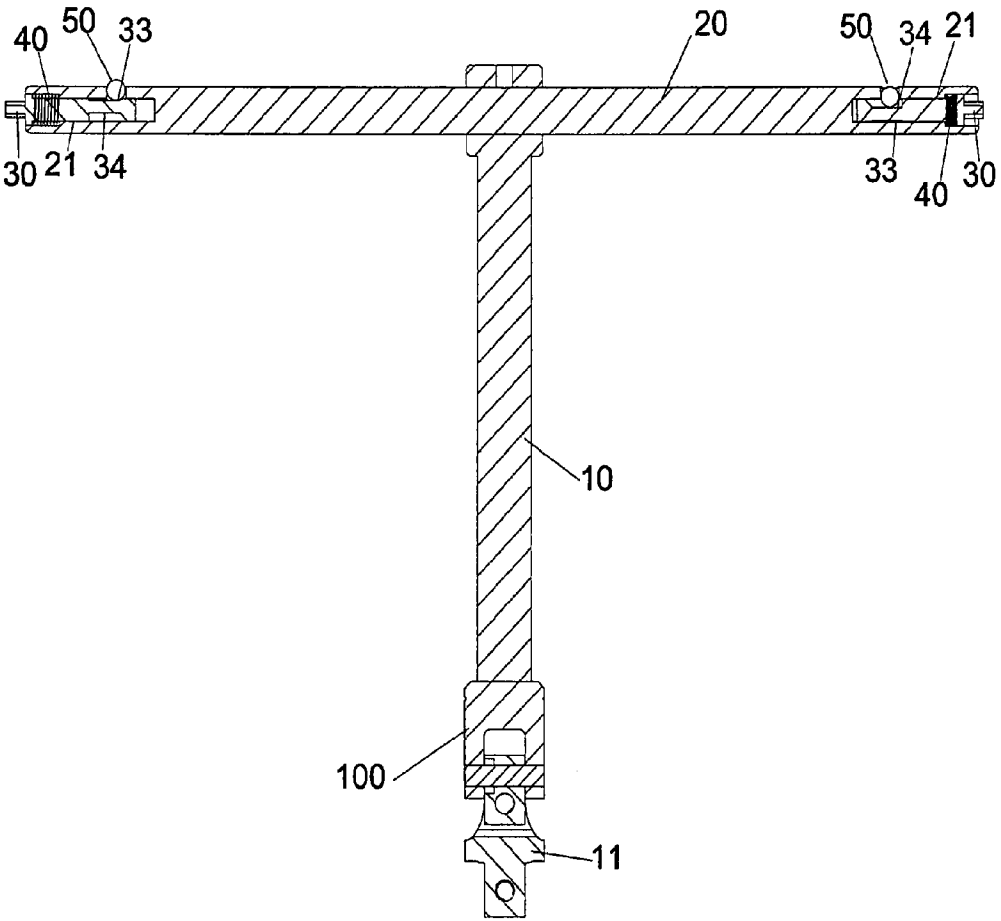
PRIOR ART FIG. 30
FIG. 30 is a cross-sectional view to show that the engaging member, in FIG. 27, is retracted into the end section of the bar.
Figure 31:
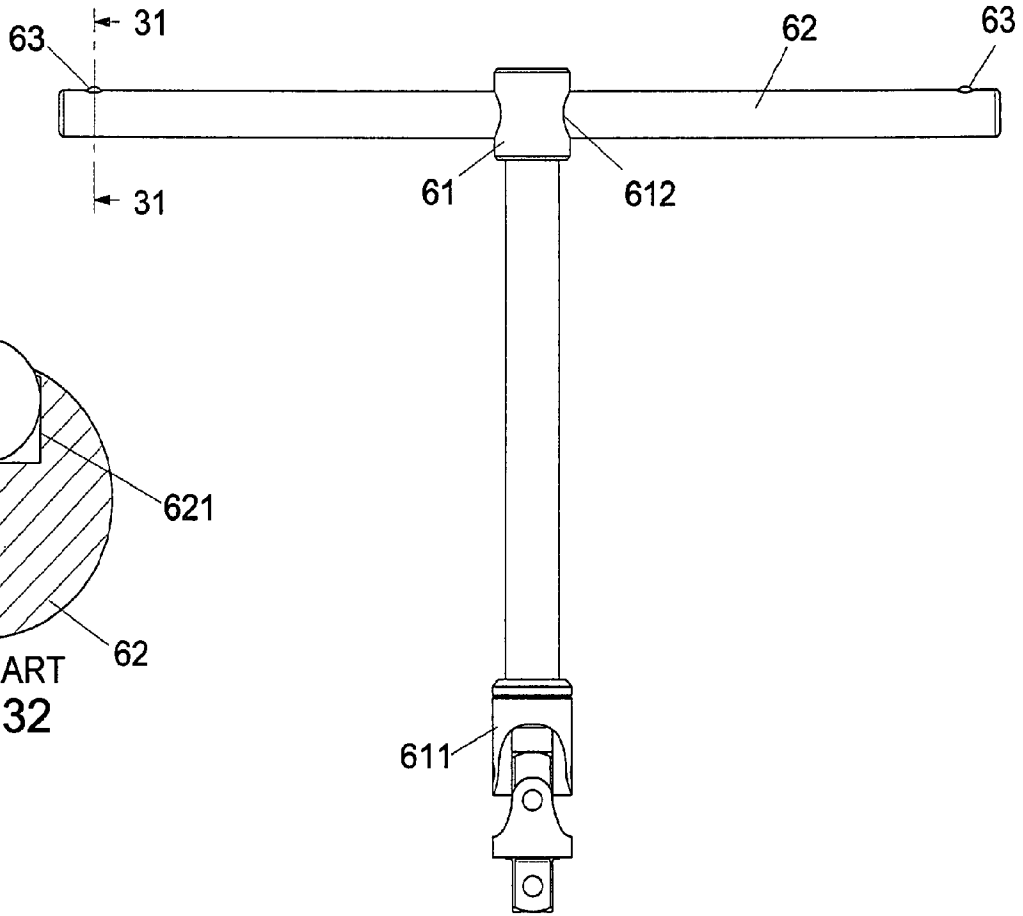
PRIOR ART FIG. 31
FIG. 31 shows a conventional driving tool.
Figure 32:
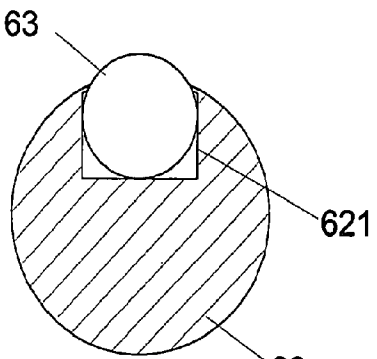
PRIOR ART FIG. 32
FIG. 32 is a cross sectional view taken along line 31-31 in FIG. 31.

As shown in FIG. 19, the second end of the driving shaft 10 has an engaging portion 13 extending from the other end opposite to the connection portion 100, and the engaging portion 13 has a polygonal recess defined therein. When the driving shaft 10 and the bar 20 are separated, the driving shaft 10 can be used as a connecting rod.

As shown in FIGS. 20 to 26, in an embodiment of the present invention, the first and second notches 33, 34 are defined around an axis of the control rod 30. A guide groove 331 communicates between the first and second notches 33, 34. When the control rod 30 is applied by a torsion force, the control rod 30 moves relative to the recess 21 and the engaging member 50 moves from the first notch 33 to the second notch 34 via the guide groove 331 and is retracted into the bar 20. The depth of the guide groove 331 is gradually deeper from the first notch 33 toward the second notch 34. Two first lines 23 are marked on outside of the recess 21 of the at least one end section 200 and the control rod 30 includes an enlarged head 32 which includes a second line 35 marked thereon. When the second line 35 is in alignment with the two first lines 23 respectively, the engaging member 50 is located in the first and second notches 33, 34 respectively.

As shown in FIGS. 27 to 30, in an embodiment of the present invention, the first and second notches 33, 34 are defined in opposite ends of a diameter of the control rod 30. A guide groove 331 communicates between the first and second notches 33, 34. The width of the guide groove 331 is smaller than that of the first and second notches 33, 34. The depth of the guide groove 331 is gradually deeper from the first notch 33 toward the second notch 34. When the control rod 30 is applied by an axial force and a torsion force, the control rod 30 moves relative to the recess 21 and the engaging member 50 moves from the first notch 33 to the guide groove 331. The control rod 30 is then rotated relative to the recess 21 and the engaging member 50 moves from the guide groove 331 to the second notch 34. Two first lines 23 are marked on outside of the recess 21 of the at least one end section 200 and the control rod 30 includes an enlarged head 32 which includes a second line 35 marked thereon. When the second line 35 is in alignment with the two first lines 23 respectively, the engaging member 50 is located in the first and second notches 33, 34 respectively.

The invention includes the following advantages:

1. At least one of the end sections 200 of the bar 20 has the control mechanism 3 to control the engaging member 50 to protrude or to be retracted. When the engaging member 50 protrudes from the surface of the bar 20, the bar 20 can move relative to the driving shaft 10 to adjust the length of the arm of force and cannot be separated from the driving shaft 10. When replacing the driving shaft 10 to have different driving member 11, the control rod 30 is pushed to retract the engaging member 50 into the bar 20, the bar 20 can be separated from the driving shaft 10 to replace the driving shaft 10 with different driving member 11 or connection portion 100.

2. The bar 20 can be connected to any conventional driving shaft 10 which can be functioned as desired.

3. The bar 20 and the driving shaft 10 are able to be separated so that they can be easily organized in the tool box.

In practical use, the bar 20 and the driving shaft 10 can be many different sizes and lengths, so that they can be individually stored in the tool box.

While we have shown and described the embodiment in accordance with the present invention, it should be clear to those skilled in the art that further embodiments may be made without departing from the scope of the present invention.

What is claimed is:

1. A driving tool comprising:

a driving shaft having a first end and a second end, the first end of the driving shaft having a passage and a connection portion connected to the second end of the driving shaft, a driving member connected to the connection portion, and a bar movably extending through the passage and having two end sections on two ends thereof, each end section having an engaging member protruding out from outer surface thereof, at least one of the two end sections having a control mechanism connected thereto, the control mechanism controlling the engaging member to be retracted into the end section, a hole defined radially through a wall of the at least one end section and a recess defined in an end of the at least one end section, the engaging member located in the hole and being a ball, the recess being defined axially in the end of the at least one end section, a control rod and a resilient member received in the recess, the resilient member applying a force to the control rod, the control rod having a first notch and a second notch which is deeper than that of the first notch, when the control rod is located at a first position, the engaging member is engaged with the first notch which pushes the engaging member to partially protrude from the at least one end section, when the control rod is operated to overcome a force of the resilient and located at a second position, the engaging member is engaged with the second notch so that the engaging member is retracted into the at least one end section.

2. The driving tool as claimed in claim 1, wherein the second end of the driving shaft has an engaging portion extending therefrom which has a polygonal recess defined therein.

3. The driving tool as claimed in claim 1, wherein the first and second notches are located axially in the control rod, an inclined surface is connected between the first and second notches, when the control rod is applied an axial force, the control rod moves relative to the recess and the engaging member moves from the first notch to the second notch via the inclined surface.

4. The driving tool as claimed in claim 3, wherein the recess includes a first section and a second section, the first section has an inner diameter larger than that of the second section so as to form a shoulder between the first and second sections, the control rod includes an enlarged head which is located within the first section of the recess, the resilient member is a spring which is mounted to the control rod and two ends of the resilient member are biased between the head and the shoulder between the first and second sections.

5. The device as claimed in claim 1, wherein the first and second notches are defined around an axis of the control rod, a guide groove communicates between the first and second notches, when the control rod is applied by a torsion force, the control rod moves relative to the recess and the engaging member moves from the first notch to the second notch via the guide groove.

6. The driving tool as claimed in claim 5, wherein a depth of the guide groove is gradually deeper from the first notch toward the second notch.

7. The driving tool as claimed in claim 5, wherein two first lines are marked on outside of the recess of the at least one end section and the control rod includes an enlarged head which includes a second line marked thereon, when the second line is in alignment with the two first lines respectively, the engaging member is located in the first and second notches respectively.

8. The device as claimed in claim 1, wherein the first and second notches are defined in opposite ends of a diameter of the control rod, a guide groove communicates between the first and second notches, a width of the guide groove is smaller than that of the first and second notches, when the control rod is applied by an axial force and a torsion force, the control rod moves relative to the recess and the engaging member moves from the first notch to the guide groove, the control rod is then rotated relative to the recess and the engaging member moves from the guide groove to the second notch.

9. The driving tool as claimed in claim 8, wherein a depth of the guide groove is gradually deeper from the first notch toward the second notch.

10. The driving tool as claimed in claim 8, wherein two first lines are marked on outside of the recess of the at least one end section and the control rod includes an enlarged head which includes a second line marked thereon, when the second line is in alignment with the two first lines respectively, the engaging member is located in the first and second notches respectively.

11. The driving tool as claimed in claim 1, wherein the driving member is a socket.

12. The driving tool as claimed in claim 1, wherein the connection portion is connected to the driving member via a universe connector.

13. The driving tool as claimed in claim 1, wherein the driving member is a bit which has a cabinet tip, a Phillips head tip or a hexagonal tip.

14. The driving tool as claimed in claim 1, wherein the two end sections each have the control mechanism connected thereto so control the two engaging members to be retracted into the two end sections.

15. The driving tool as claimed in claim 1, wherein the bar has an axial passage defined therethrough which communicates with the two end sections, the control rod extends through the axial passage of the bar and includes two sets of first and second notches in the two ends thereof, when the control rod moves, the two engaging members are located in either the two first notches or the two second notches respectively.

* * * * *